US006289973B1

(12) United States Patent
Roehrig et al.

(10) Patent No.: US 6,289,973 B1
(45) Date of Patent: Sep. 18, 2001

(54) DEVICE AND METHOD FOR EXCHANGING A REPLACEABLE PART OF A MOULD ARRANGEMENT IN A CONTINUOUS CASTING INSTALLATION

(75) Inventors: Adalbert Roehrig, Thalwil; Adrian Stilli, Bulach, both of (CH)

(73) Assignee: Concast Standard AG, Zurich (CH)

( * ) Notice: Subject to any disclaimer, the term of this patent is extended or adjusted under 35 U.S.C. 154(b) by 0 days.

(21) Appl. No.: 09/499,945

(22) Filed: Feb. 8, 2000

Related U.S. Application Data

(63) Continuation of application No. PCT/EP98/04447, filed on Jul. 16, 1998.

(30) Foreign Application Priority Data

Aug. 8, 1997 (CH) ..... 1871/97

(51) Int. Cl.[7] ..... B22D 11/04; B22D 33/04

(52) U.S. Cl. ..... 164/478; 164/416; 164/418; 164/459; 164/443; 164/485; 164/137; 164/339; 164/341

(58) Field of Search ..... 164/418, 459, 164/443, 137, 121, 339, 341, 342, 485, 478, 416

(56) References Cited

U.S. PATENT DOCUMENTS 3,273,208 9/1966 Greenberger .
4,129,173 * 12/1978 Scheurecker et al. ..... 164/418

FOREIGN PATENT DOCUMENTS

2914054 * 12/1979 (DE) ..... 164/418
3207 149 C1 7/1983 (DE) .
2442092 * 7/1980 (FR) ..... 164/418
42-25544 * 12/1979 (JP) ..... 164/443
62009749 1/1987 (JP) .
84 507 10/1984 (LU) .

* cited by examiner

*Primary Examiner*—Nam Nguyen
*Assistant Examiner*—I.-H. Lin
(74) *Attorney, Agent, or Firm*—Darby & Darby

(57) ABSTRACT

A continuous casting installation comprises an ingot mould and an oscillating holding device used for causing the ingot mould to swing when in a casting position. The installation consists, in a separable manner, of an interchangeable part and a stationary part. To replace the intechangeable part, it is separated from the stationary one and moved using a conveying means, at least along a partial path, from its position of operation into an area beneath the casting position. This enables, especially in the multiline casting installations, the interchangeable part to be transported during the casting process and, for example, along paths comprising straight or arciform segments, to any purposefully selected position and to be replaced by a new interchangeable part to be replaced in multiline installations with no interference with the casting process in any adjacent ingot arrangement.

15 Claims, 5 Drawing Sheets

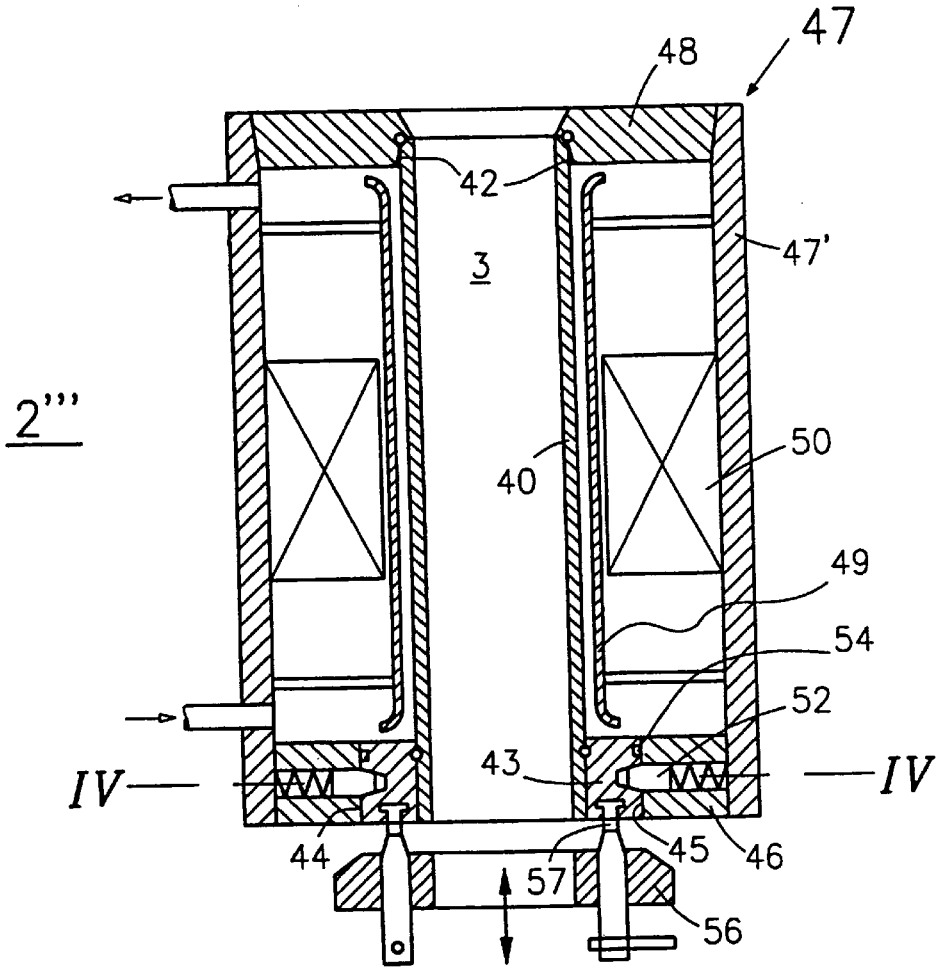
Fig. 4
Fig. 5
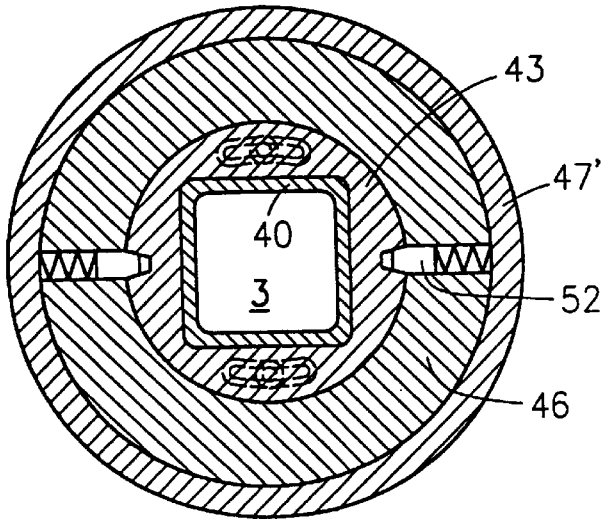

DEVICE AND METHOD FOR EXCHANGING A REPLACEABLE PART OF A MOULD ARRANGEMENT IN A CONTINUOUS CASTING INSTALLATION

This is a continuation of International Application No. PCT/EP98/04447, filed Jul. 16, 1998.

FIELD OF THE INVENTION

The invention relates to a continuous casting installation having a device for exchanging a replaceable part of a mould arrangement in the continuous casting installation according to the precharacterising clause of claim 1 and to a method of exchanging a replaceable part of the continuous casting installation according to claim 1.

BACKGROUND OF THE INVENTION

As a rule, in continuous casting installations, especially continuous steel casting installations, it is necessary from time to time to replace a mould or at least a component of a mould. Thus, for example, when the cavity of a mould is subjected constantly to the effects of strand solidification, the wall defining the mould cavity eventually begins to exhibit wear phenomena and has to be repaired or replaced.

Accidents occurring during casting operation, such as perforation of a strand shell or overflow of the metal melt over the pouring opening of the mould, lead, as a rule, to an interruption in casting operation of the relevant mould. In general, parts of the continuous casting installation, in particular the mould or parts of the mould and strand guiding devices below the mould have to be freed from solidified metal or even replaced before casting operation may be resumed.

Moulds are conventionally supported in a continuous casting installation by a holding device which is so constructed that the moulds may oscillate in a casting position. The holding device usually takes the form of an oscillating table, which is accessible from above for the purpose of installing and removing a mould. In a multi-strand installation with moulds having vertical or oblique cavities, tundishes are arranged above the moulds during casting operation, molten metal being poured from these tundishes into the mould cavities, wherein a plurality of moulds is conventionally supplied with melt from one tundish comprising several outlets. An accident entailing replacement of a mould requires the casting operation to be stopped at the mould affected by the accident and consequently results in a reduction in the casting yield of the multi-strand installation, since the tundish blocks access to the moulds from above and the necessary mould exchange is only possible in a break in casting after removal of the tundish.

A continuous casting installation is known from U.S. Pat. No. 3, 273,208 which is suitable for long sequential casts and is provided with an apparatus for quick mould replacement. The mould is arranged on a sliding table which is capable of rectilinear, horizontal displacement and interacts with a mould delivery carriage displaceable perpendicularly thereto or with a turntable. The displaceable sliding table requires open holes in the teeming platform floor along the displacement path, which holes are undesirable for reasons of safety. If a turntable is used in conjunction with multi-strand installations, large gaps are needed between strands, making large tundishes necessary. Installation of this swapping device in multi-strand installations leads not only to high structural complexity but also to high operating costs, stemming from maintenance of the wear-prone tundishes.

Moreover, when molten metal is poured from one tundish into a plurality of moulds, variations occur in the casting parameters, for example differences in casting temperature or in the superheating temperature in the various moulds. These variations are generally greater, the larger the strand spacing and lead to unacceptable variations in the quality of the strands withdrawn from the different moulds.

JOS 62-9749, discloses a device for exchanging a mould in a continuous casting installation equipped with an oscillatory holding device for the mould. The holding device comprises a deck, to which the mould may be fixed in an operating position and the height of which may be adjusted by means of two lever systems provided with independent drives. A first lever system enables the deck to be lowered and raised and serves as a conveying device for conveying the mould out of the operating position into a second position, in which the mould may be gripped by a second conveying device below the teeming platform, lifted from the deck and conveyed on further. A second lever system permits oscillation of the mould about the position set by the first lever system, the assembly comprising the mould, the deck and the first lever system being set in motion as a whole by means of the second lever system. This design has the disadvantage that, during casting operation, a relatively large overall weight has to be kept in motion in order for the mould to oscillate and that the first lever system has to undergo complex stabilisation with respect to the vibrations transmitted by the second lever system, in order to be able to maintain the casting conditions in a controlled manner over a relatively long period. Furthermore, in the initial phase of mould replacement a relatively large weight in addition to the mould has to be moved by means of the conveying device.

A mould is known from DE 32 07 149, which is attached in releasable manner to an oscillating elevating platform and comprises a water chamber, upper and lower flange plates, a water conveying jacket and a mould tube. The flange plates, the mould tube and the water conveying jacket form a unit, held together by connecting members, which may, am a compact, adjusted structural component, be withdrawn upwards out of the water chamber by a crane or introduced from above into the water chamber and can therefore only be exchanged above the mould during a break in casting and after removal of the tundish.

LU 84 507 discloses a multistrand casting installation with an arrangement of moulds in which each mould, including all its accessories, such as in particular the mould oscillating device, is arranged on a frame which is mounted on a lowerable platform so as to be displaceable in the longitudinal direction. When the platform has been lowered, the mould may be moved, together with the oscillating device, which consists of an oscillating mechanism and a drive motor, along the platform to a position below the operating position, where it may be separated from the oscillating device and then exchanged. With this arrangement too, a relatively large weight has to be moved before the mould may be exchanged.

The object of the invention is to avoid the disadvantages of the known devices and to provide a structurally simplified device and a method for exchanging a replaceable part of a mould arrangement in a continuous casting installation, the intention being to make it possible to carry out the replacement process on an individual selected mould in a multi-strand installation while the casting operation remains active.

SUMMARY OF THE INVENTION

The object is achieved in accordance with the invention by a continuous casting installation having a mould arrangement. The mould arrangement is formed of a stationary part and a replaceable part. The oscillatory holding device is formed as a component of the stationary part and causes the mould to oscillate in a casting position. The replaceable part is separably connected with the stationary part. The replaceable part comprises at least one component of the mould. The installation also includes a device for exchanging the replaceable part. The device comprises a conveying device for conveying the replaceable part between an operating (casting) position and a second position in a space below the operating position, wherein the stationary part comprises the holding device and the holding device and the replaceable part are so constructed such that the replaceable part may be moved by means of the conveying device out of the operating position into the second position after separation from the stationary part. The present invention also includes a method of exchanging a replaceable part of a mould arrangement in a continuous casting installation.

It is assumed that, in addition to a mould cavity wall, which forms a strand, the mould comprises a supporting structure for the mould cavity wall. By means of the supporting structure, a separable connection may be produced between the mould cavity wall and the oscillatory holding device. The holding device determines the casting position of the mould. During the casting operation, the replaceable part is in an operating position. The mould arrangement also includes a stationary part which is connected with the replaceable part during the casting operation and remains behind when the replaceable part is removed from the operating position using the conveying device after the casting operation is completed. By definition, the stationary part comprises at least the holding device.

According to the invention, the replaceable part comprises at least one component of the mould, wherein the holding device and the replaceable part are so constructed that the replaceable part may be moved by means of the conveying device out of the operating position into a space below the casting position after separation from the stationary part. By first of all separating the replaceable part from the stationary part at the beginning of the replacement process, the replaceable part is uncoupled from the oscillatory holding device. In this way, it is possible to replace the replaceable part without moving the stationary part. Thus, the weight load on the conveying device when in operation may be reduced to a minimum. Moreover, the conveying device may be so designed that it is separate from the holding device and the holding device, together with the mould, may oscillate during the casting operation without being affected by the conveying device.

Since, according to the invention, the replaceable part may be moved out of the operating position into a space below the casting position by means of the conveying device after separation from the stationary part, the replaceable part may be exchanged in multi-strand installations even during the casting operation, even if tundishes above the moulds block access to the replaceable parts from above. Moreover, it is possible for multi-strand installations to be produced with any strand spacing desired and for a device according to the invention to be constructed to conform to a predetermined strand spacing.

The spatial arrangement of the replaceable part during the casting operation is designated below as the operating position of the replaceable part. A part of the mould arrangement which is connected with the replaceable part during the casting operation, which defines the spatial arrangement of the replaceable part and which remains behind when the replaceable part is removed from the operating position with the aid of the conveying device is designated the stationary part. This may be such that parts of the mould and/or the mould itself may be replaced. In each instance, the replaceable part may be gripped by the conveying device.

In one embodiment, the replaceable part merely comprises the mould cavity wall. Thus, it is possible to replace only that part of a mould which is subject to the greatest wear, without having to move the other parts of the mould or the mould arrangement, which are as a rule of a much greater weight than the mould cavity wall. The stationary part of the mould arrangement may be equipped with guide members, to simplify automatic positioning of the replaceable part upon movement into its operating position. Seals, which may be incorporated into the guide members, are provided to seal the mould cavity wall automatically during exchange against the leakage of coolant, which may act on the mould cavity wall. This embodiment is particularly easy to produce in conjunction with a spray-cooled mould; in this instance, a spray cooling device for cooling the mould cavity wall may be associated with the stationary part of the mould arrangement. This embodiment may also be used, however, in moulds having water jacket cooling.

In another embodiment, the replaceable part consists of the mould cavity wall with a coolant channel for cooling the mould cavity wall. The coolant channel may take the form, for example, of a water cooling jacket surrounding the mould cavity wall. In the case of such an embodiment, it is particularly advantageous to provide the stationary part of the mould arrangement with a supply connection for the coolant, such that the coolant channel is automatically connected to the supply connection when the replaceable part is brought into the operating position.

In a further embodiment of the invention, the replaceable part comprises the mould in its entirety. In this case, the supporting structure of the mould cavity wall is connected separably with the holding device in such a way that the mould may be gripped by the conveying device and moved out of the operating position into a space below the casting position.

The mould or mould arrangement may conventionally comprise devices which serve to influence the casting and/or solidification processes and/or the monitoring and/or control of the operation of the continuous casting installation. Further embodiments according to the invention differ as to which of the above-mentioned devices are associated with the stationary part of the mould arrangement and which with the replaceable part.

It is advantageous to arrange on the replaceable part devices which are intended to act on an exiting strand directly at the outlet opening of the mould cavity. Examples of these devices are foot rollers and/or spray cooling devices and/or an electromagnetic agitator for the strand.

Devices which have to be replaced less frequently may advantageously be constructed as components of the stationary part of the mould arrangement and connected with the holding device, for example at the periphery of the mould, or, if the supporting structure for the mould cavity wall is associated with the stationary part, be arranged on the supporting structure. Examples of such devices are devices for electromagnetic agitation and/or braking of the metal melt in the mould cavity and/or in the strand or a spray cooling device for the strand. If such devices are particularly heavy, then their association with the stationary part of the mould arrangement results in a particularly advantageous embodiment of the device according to the invention, since the conveying device may be designed to cope with smaller loads.

Similarly, devices which have to be operated in conjunction with complex supply apparatuses may advantageously be associated with the stationary part of the mould arrangement, so that the gate to the supply apparatus need not be of an excessively complex design, for example in the form of detachable supply connections. Into this category fall, for example, measuring devices for monitoring the casting operation, especially for measuring the level of the meniscus and/or for monitoring the temperature of parts of the mould.

Further embodiments of the device according to the invention relate to a replaceable part comprising one or more components requiring supply via stationary supply connections. In this instance, the stationary part comprises at least one supply connection and the replaceable part is so constructed that the supply connection is coupled to or uncoupled from a corresponding supply connection during exchange of the replaceable part in order respectively to effect or undo a supply connection. Such supply connections may serve in the supply of energy or coolants or lubricants or in the exchange of signals. For example, by means of automatically connectable supply connections an electromagnetic agitator incorporated into the replaceable part may be supplied with electrical energy, a lubricant duct opening into the mould cavity may be fed with lubricant or measuring and/or control signals may be exchanged between a controllable device connected with the replaceable part or a measuring probe, for example a temperature probe for measuring the temperature in the mould cavity wall or other segments of the replaceable part, and control and/or measuring devices at the periphery of the replaceable part.

Various embodiments are feasible for the conveying device, depending on the configuration of the mould arrangement. The conveying device may comprise a lifting device, with which the replaceable part may be connected and which is constructed in such a way that the replaceable part may be moved out of the operating position into the space below the casting position. The conveying device may be constructed in such a way that the replaceable part may be moved out of the operating position substantially tangentially, at least along a proportion of its path, to the strand conveying direction at the outlet opening- This embodiment of the conveying device has the advantage that the replaceable part traverses a particularly small space during exchange. In this way it is possible to make the mould arrangement particularly compact. If, in particular, components of the stationary part of the mould arrangement, for example an electromagnetic agitator or a meniscus measuring device, are positioned at as small as possible a distance from the replaceable part, there is little play available when the replaceable part is removed from its operating position during exchange.

In another modification of the conveying device, the replaceable part may be moved out of the operating position on a path which is in part rectilinear and/or in part curved. This results in the advantageously useful possibility of moving the replaceable part out of the operating position into any appropriate position in which the replaceable part may undergo further treatment. In a continuous casting installation in which the strand is guided through a secondary cooling chamber immediately after leaving the mould, it is possible, for example, for the conveying device to be constructed in such a way that it may be positioned outside the secondary cooling chamber and the replaceable part may be gripped by means of a closeable opening in the cooling chamber wall and, after moving tangentially to the strand guiding direction, be conveyed sideways out of the secondary cooling chamber. During the casting operation, the conveying device would be extensively protected from influences which might impair said casting operation, for example developing from strand breakaway, by the cooling chamber wall. Moreover, it is possible to construct the conveying device as a mobile unit. In the case of multi-strand installations, this construction has the advantage that several moulds may be served by the same conveying device, by positioning the conveying device, as appropriate, in the vicinity of the replaceable part to be exchanged. It is also feasible to arrange the conveying device stationarily with respect to the continuous casting installation. For example, each mould may be associated with a conveying device. This avoids complex positioning of a conveying device once it has been adapted to one replaceable part. In this way, automation of a device according to the invention is simplified.

DESCRIPTION OF THE DRAWINGS

Examples of the invention will be described below with the aid of Figures, in which:

FIG. 4 shows a vertical section through a further example of a mould arrangement, FIG. 5 shows a section along line IV—IV of FIG. 4.

DESCRIPTION OF THE INVENTION

Figure 1:
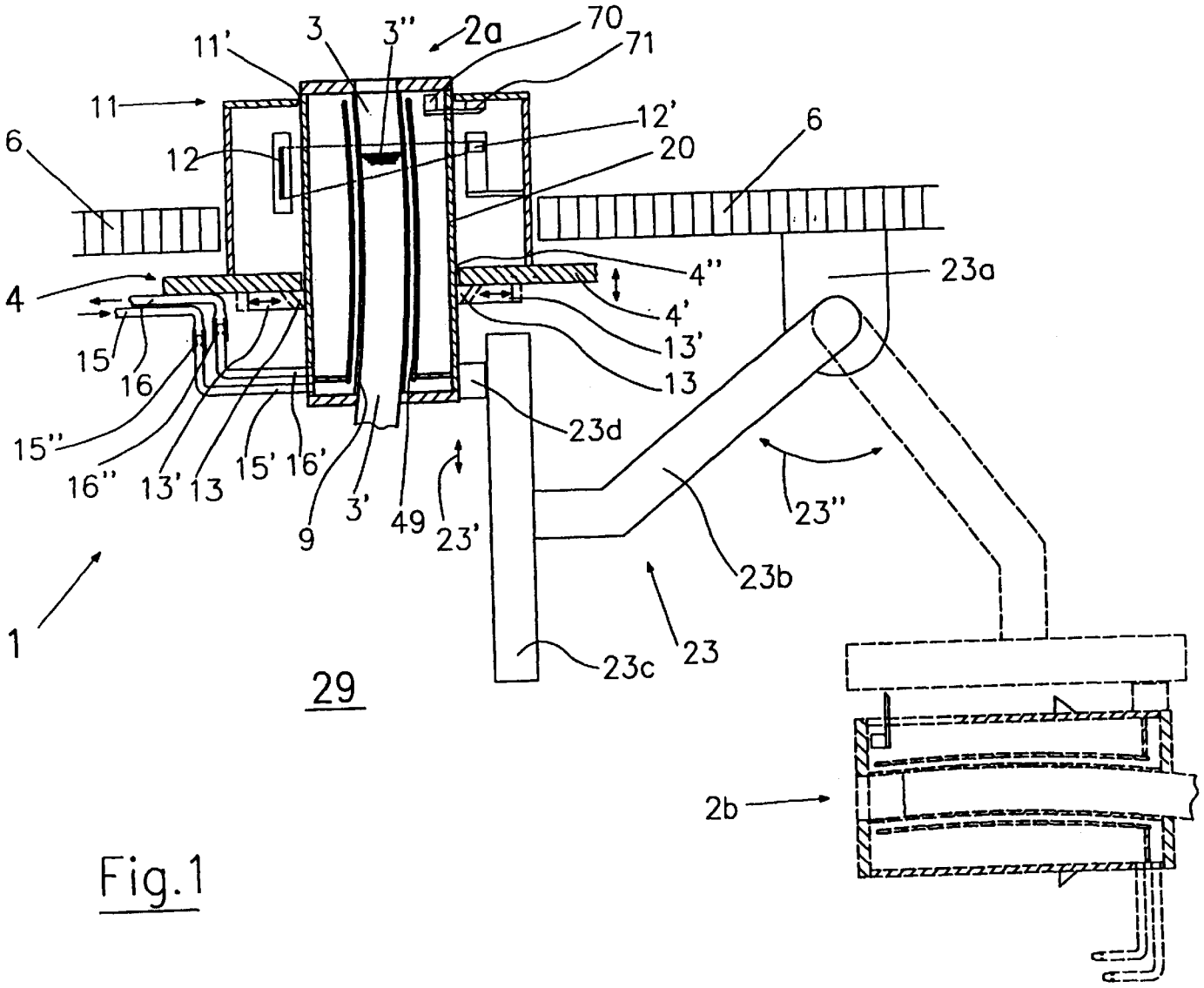
FIG. 1 shows a vertical section through a mould arrangement

FIG. 1 shows a mould arrangement 1 which projects through an opening in the floor 6 of a teeming platform. The mould arrangement 1 comprises a mould 2 with a mould cavity 3 and a holding device 4 for the mould 2. The mould 2 is designed to be a replaceable part of the mould arrangement 2 and may be separated from the other components of the mould arrangement 1 forming a stationary part and moved by means of a conveying device 23. Reference numerals 2*a*, 2*b* etc. will be used below to indicate different positions of the mould 2. The mould cavity 3 consists of a mould cavity wall 9 with a pouring opening at the upper end and an outlet opening for a strand 3' at the lower end of the mould 2. FIG. 1 shows the strand 3' as a solidified strand remnant which is cut off directly at the outlet opening of the mould 2 and comprises an upper end 3" corresponding to the meniscus during casting operation. The mould 2 comprises an external jacket 20 which serves as a supporting structure for the mould cavity wall 9 and may be connected to the holding device 4. The space between the jacket 20 and the mould cavity wall 9 is constructed for the passage of a coolant, for example water, wherein a gap between the mould cavity wall 9 and a pipe 49 surrounding the mould cavity wall 9 serves as a coolant channel through which the coolant may be conveyed from a supply line 15' to a discharge line 16'.

The holding device 4 is constructed as a mould table 4' with an opening through which the mould 2 may be brought from below into a casting position 2*a* and with wedges 13' displaceable along the mould table 4'. As is indicated in FIG. 1 by a double-headed arrow in the strand guiding direction, the holding device 4 may be caused to oscillate by a drive which is not shown. The casting position 2*a* is defined by positioning members 13 which are connected with the mould 2 and which may be brought into releasable connection with the mould table 4' by means of the wedges 13'. The ends of the coolant supply and discharge lines 15' and 16' remote from the jacket 20 of the mould are each constructed as supply connections. These are so formed that they may be separably connected at coupling points 15" and 16" with corresponding coolant supply and discharge lines 15 and 16 arranged on the stationary part of the mould arrangement when the mould is brought into the casting position 2*a*.

During casting operation, the part of the mould 2*a* projecting beyond the mould table 4' is surrounded by a casing 11, which houses various devices required during casting operation and associated with the stationary part of the mould arrangement 1, for example a measuring unit, consisting of a radioactive radiator 12 and a detector 12', for monitoring the meniscus 3" or an electromagnetic agitator (not shown). An example of an energy and/or signal supply connection which may be effected or separated during exchange of the mould 2*a* is the temperature measuring device 70 indicated in FIG. 1, which is installed to measure the temperature of the coolant at the end of the pipe 49 on the outlet side and may be connected via electrical contacts on the outside of the mould with corresponding contacts 71 on the casing 11, in order to ensure the supply of electrical energy or the exchange of measuring and/or control signals.

The conveying device 23 enables the mould 2 to move with two degrees of freedom and is composed of several functional groups 23*a*, 23*b*, 23*c*, 23*d*. A connection between the conveying device 23 and the mould 2*a* may be produced by means of a coupling element 23*d*. The coupling element 23*d* may be moved by means of the linear thruster 23*c* in the direction of arrow 23', wherein the linear thruster 23*c* may in turn be moved in the direction of arrow 231" by means of the swivel arm 23*b* and a stationary swivelling device 23*a* for the swivel arm 23*b*.

To exchange the mould 2*a*, the coupling element 23*d* is connected with the mould 2*a* after suitable positioning of the conveying device 23 and the connection between the mould 2*a* and the holding device 4 is released by movement of the wedge 13'. By actuation of the linear thruster 23*c*, the mould is then moved longitudinally of the arrow 23', i.e. substantially tangentially to the direction of guidance of the strand 3' at the outlet opening of the mould 2*a*, into a space 29 below the casting position 2*a*, wherein the supply connection of the supply and discharge lines 15, 15' and 16, 16' respectively is disconnected at the respective coupling points 15" and 16". To this end, openings in the mould table 4' and in the casing 11 serve as guide surfaces 4" and 11'. The mould 2 may then be conveyed; through actuation of the swivelling device 23*a*, into an appropriate position for further treatment of the mould 2, for example into the position 2*b* indicated in FIG. 1. These processes may be reversed for insertion of a new mould 2 into the casting position 2*a*.

Figure 2:
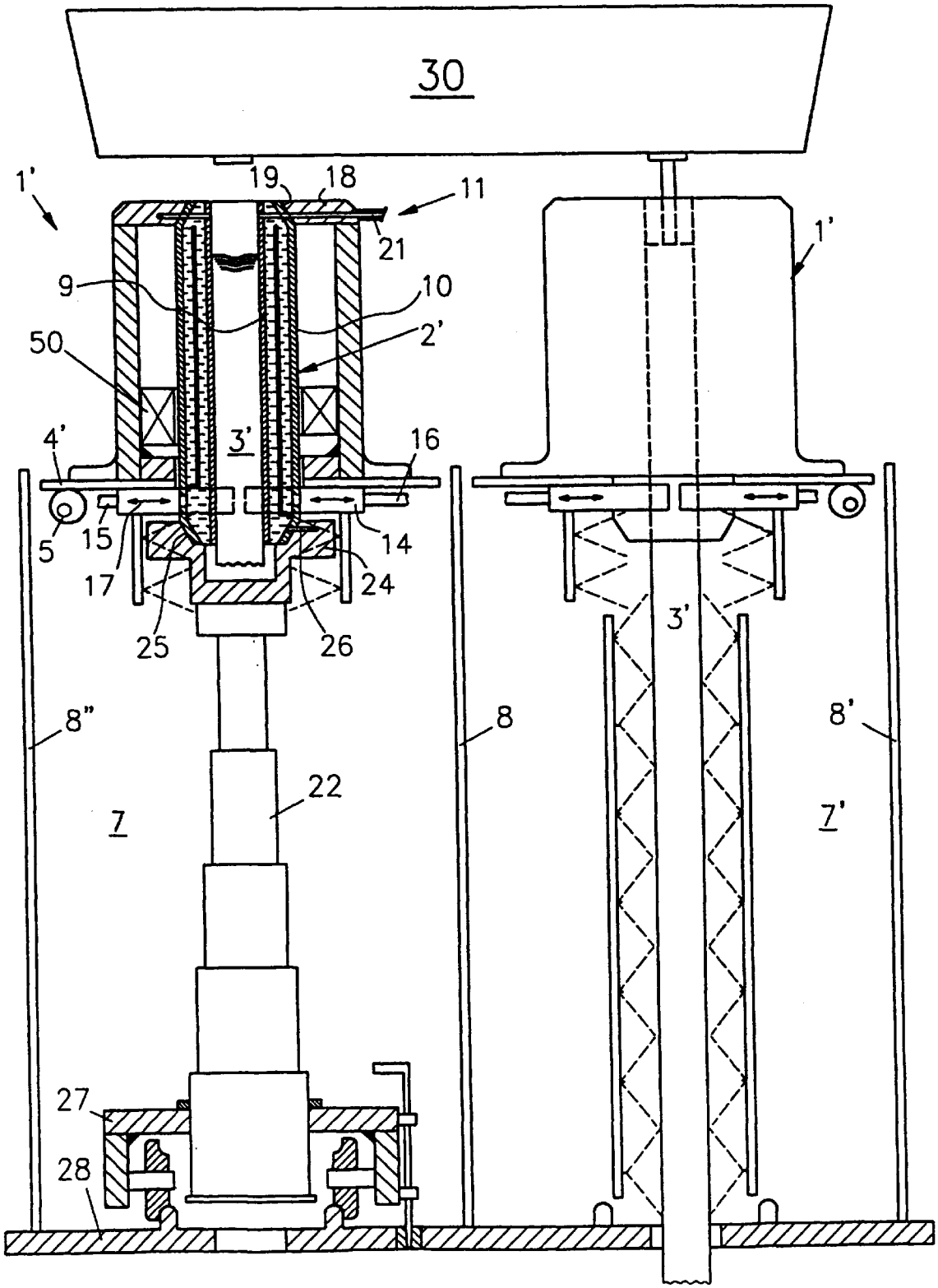
FIG. 2 shows a vertical section through a two-strand installation

FIG. 2 shows a teeming vessel 30, which serves as a tundish for two strands 3', above two mould arrangements 1'. The mould arrangements 1' are positioned on a mould table 4', which may be caused to vibrate by an oscillating apparatus 5. Secondary cooling chambers 7, 7' with partition walls 8, 8', 8" are disposed under the mould arrangements 1'. In the case of the left-hand strand, casting has been interrupted and the mould is being exchanged and, in the case of the right-hand strand, casting remains active.

The mould arrangements 1' each take the form of a replaceable part, consisting of a mould 2' with a mould cavity wall 9 and a supporting structure 10, constructed as a cooling water housing, for the mould cavity wall 9, and a stationary part. The stationary part comprises the mould table 4' and coupling devices 14 for cooling water supply and discharge lines 15 and 16 for connecting the supporting structure 10 to a cooling water circuit. The coupling devices 14 serve at the same time as fixing devices for the replaceable part and are constructed as sliding plates movable perpendicularly to the direction of feed of the strand (arrow 17). For reasons of greater clarity, the drive means for effecting the movement according to arrow 17 has been omitted. A lubricating oil distribution plate 18, which forms the upper part of a casing 11 of the mould 2' constitutes an additional fixing device for the inlet-side half of the replaceable part. A conical guide surface 19 serves at the same time as a centering means for the replaceable part and as a coupling surface for lubricating oil, which is supplied via a line 21.

A lifting apparatus 22 in the form of a telescopic lifting cylinder is shown below the mould arrangement 1' in the secondary cooling chamber 7. At the upper end of the lifting apparatus 22, a gripping device 24 is provided as a connecting member between the lifting apparatus 22 and the replaceable part. In conjunction with the lifting apparatus 22, the gripping device 24, provided with a centering guide 25 and movable bolts 26, may withdraw the replaceable part from its operating position or push it thereinto from below in a perpendicular direction, i.e. substantially axially with respect to the mould cavity wall 9.

In this example, the lifting apparatus 22 is arranged on a carriage 27, which may be inserted into the secondary cooling chamber 7 on an intermediate platform 28 and fixed therein. Before the carriage 27 may be inserted into the secondary cooling chamber, any cast strand which may be wedged in the mould has to be separated beneath the mould by cutting and extracted therefrom. Before or after separation, the secondary cooling spray devices and guide rollers, if present, are removed by swivelling or moving away.

Figure 3:
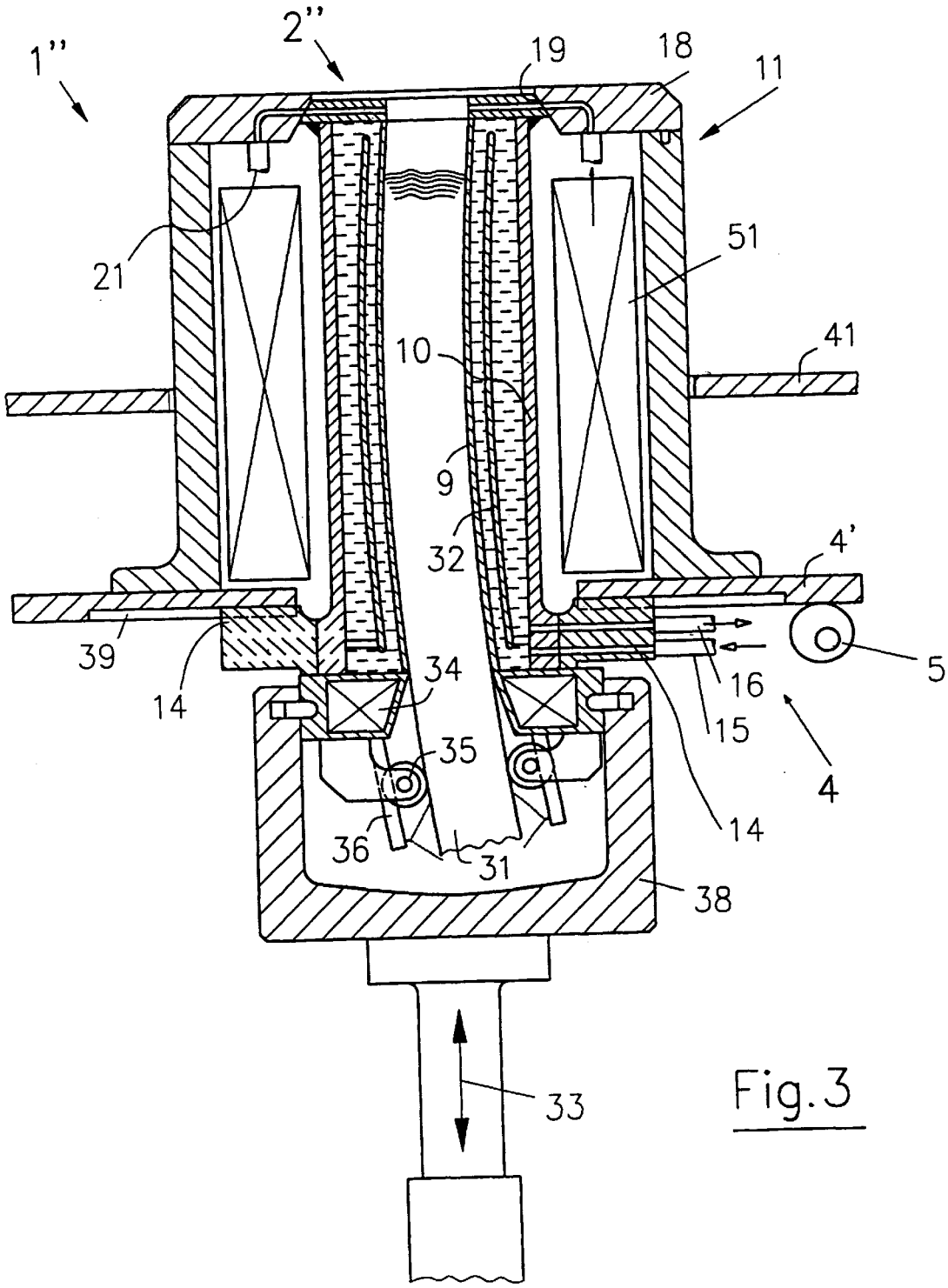
FIG. 3 shows a vertical section through a further example of a mould arrangement.

The same reference numerals are used below for identical parts of the mould arrangements. FIG. 3 shows a mould arrangement 1" with a separated strand part 31 stuck in a mould 2". The mould 2" takes the form of a replaceable part.

The supporting structure 10 for the mould cavity wall 9 of the mould 2" is provided with a guide 32 for cooling water circulation along the mould cavity wall 9. The mould cavity wall 9 is curved and may have a cross section which is round or rectangular or the like. The external form of the supporting structure 10 is cylindrical or prismatic, so that the replaceable part may be withdrawn from or pushed into the operating position rectilinearly, perpendicularly and substantially axially with respect to the mould cavity wall 9 in the direction of arrow 33.

The mould arrangement 1" in FIG. 3 is provided with various accessory parts. Inside the casing 11 and the mould 2" there is arranged an electromagnetic agitating or braking device 51. Directly below the mould cavity wall 9, on the mould 2", there are provided an agitator 34, foot rollers 35 and spraying devices 36. They are gripped, together with the stuck strand part 31, the mould cavity wall 9 and the supporting structure 10, by the appropriately constructed gripping device 38 and withdrawn vertically. The lifting apparatus may deposit the defective replaceable part in a vertical position on a replaceable part feed apparatus and take up a new one therefrom. If the gripping device 38 is arranged on the lifting apparatus so as to swivellable by, for example, 90°, the replaceable parts may also, in mechanised manner, be lifted from or deposited on the replaceable part feed apparatus in a horizontal position. The replaceable part is fixed or clamped in the casting position by coupling apparatuses 14 in the form of sliding plates which may be moved along guides 39 and by the conical guide surfaces 19 on the casing 11.

The mould exchange process may also be effected from above the teeming platform 41 using a crane when the installation is at a standstill. After removal of the lubricating oil distribution plate 18, it is possible to withdraw the mould 2" upwards. It is also possible, however, to remove the mould arrangement 1", i.e. the mould 2" and the casing 11, in an upwards direction as a unit with or without the mould table 4'.

Instead of the telescopic lifting cylinder shown in the Figures, other lifting and guide systems known from the prior art may be used. These may, for example, be so designed that the replaceable part may be moved out of the operating position to any appropriate place via a path which is in part rectilinear and/or in part curved.

FIGS. 4 and 5 show a mould arrangement comprising a replaceable part which consists of a segment of a mould 2"', especially a mould cavity wall 40 and a sealing flange 43, and comprises guide surfaces 42, 44. The sealing flange 43 is connected with the mould cavity wall 40 so as to provide a seal against cooling water leakage. The circular guide surface 44 also serves as a sealing surface and rests against a surface 45 of another annular flange 46.

The flange 46 belongs, together with a supporting structure 47 for the mould cavity wall, a water jacket 49 and an agitating device, to the stationary part of the mold 2". The supporting structure 47 consists in a guiding and supporting flange 48 and a side wall 47'.

Reference numeral 52 designates movable bolts, which fix the replaceable part and may be moved horizontally by means of movement means which are not shown. Seals are indicated schematically by small circles 54.

Below the mould there may be seen part of a partially illustrated lifting apparatus 56 for removing the mould cavity wall 40. A connection may be created between the sealing flange 43 and the lifting apparatus 56 by means of hammer-head bolts 57.

Figure 6:
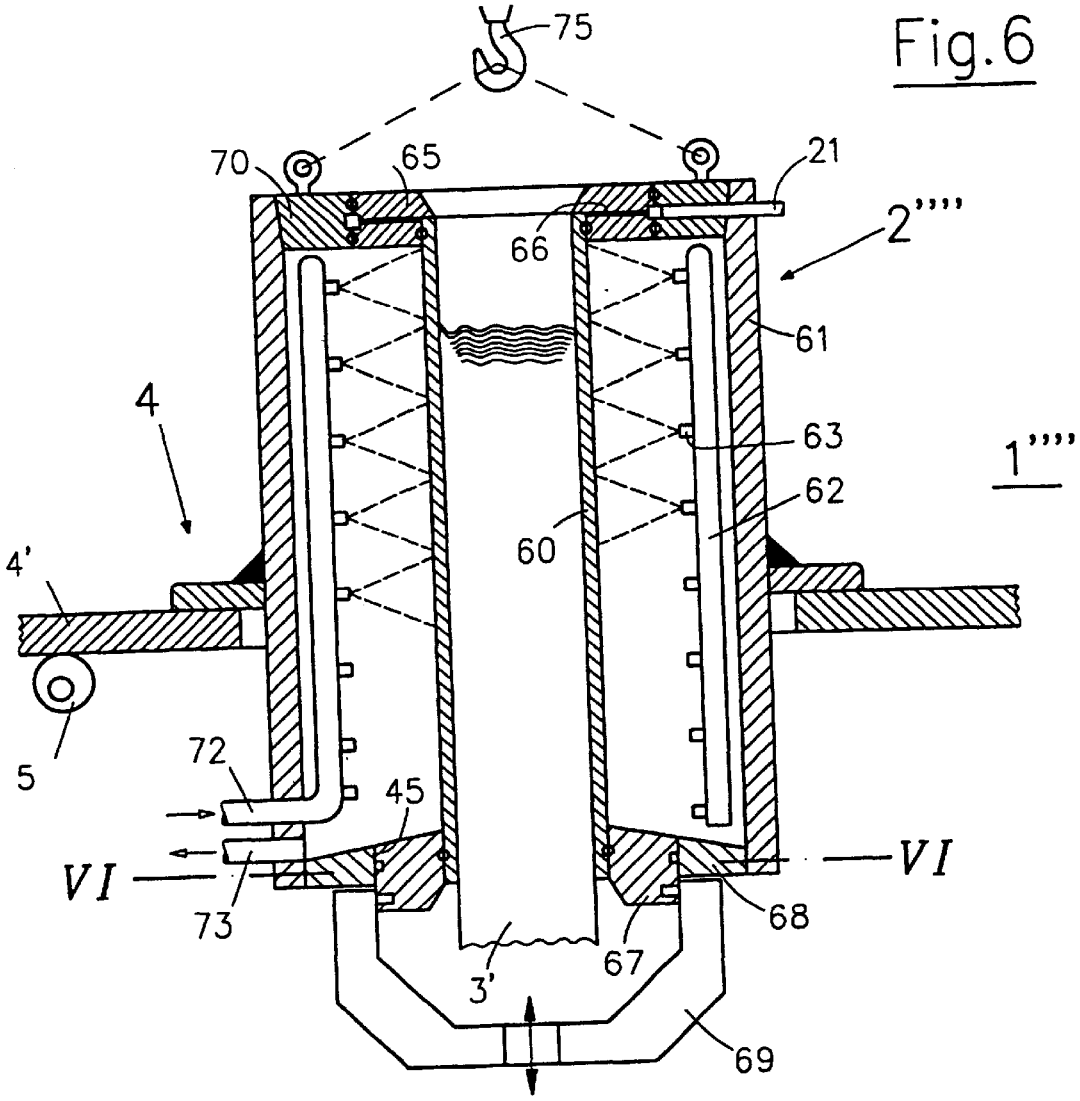
FIG. 6 shows a vertical section through a further example of a mould arrangement.
Figure 7:
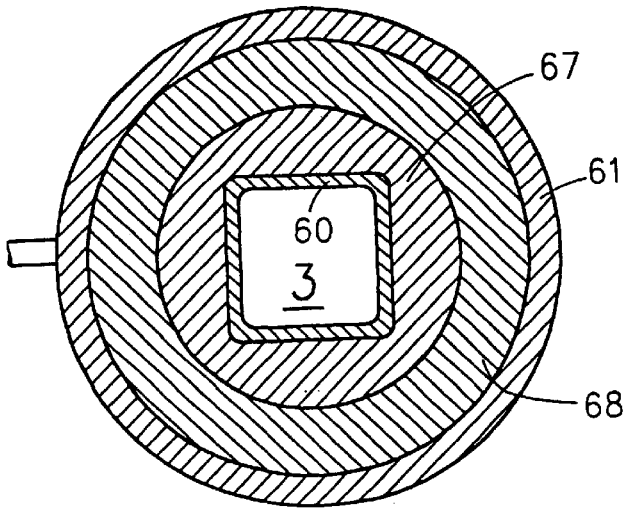
FIG. 7 shows a section along line VI—VI of FIG. 6.

In the mould arrangement 1"" according to FIGS. 6 and 7, a mould cavity wall 60 of a mould 2"" is installed in a supporting structure 61. To cool the mould cavity wall 60 there is provided a spray water cooling means consisting of spray pipes 62 and spray nozzles 63, which are connected to a supply network by means of a cooling water supply line 72 and a cooling water discharge line 73. The replaceable part of the mould arrangement 11"" consists of the mould cavity wall 60, an upper sealing flange 65 with a lubricant supply 66 and a lower sealing flange 67, which rests against a flange 68 of the supporting structure 61. A coupling part of a lifting apparatus 69 is shown schematically. Between the upper sealing flange 65 and the supporting structure 61 there is arranged another flange 70. This flange 70 may, together with the replaceable part, be removed upwards by means of a lifting device 75 after removal of the tundish.

The mould arrangements in FIGS. 1–7 comprise replaceable parts which may be exchanged according to the invention in the following method steps:

The replaceable part is separated from the stationary part of the mould arrangement and then moved out of its operating position by means of a conveying device at least along a proportion of its path into a space below the casting position.

These steps may be reversed to bring a new replaceable part into its operating position and connect it to the stationary part of the mould arrangement.

Depending on the situation, various supporting measures may appropriately be used in conjunction with these method steps, for example stoppage of the flow of molten metal, stoppage of the oscillatory motion of the mould, separation of strand remnants stuck in the mould in the vicinity of the outlet opening of the mould, temporary removal of the secondary cooling devices below the mould. In this way, the replaceable part becomes accessible to a conveying device and the play necessary for movement is ensured in the space under the casting position.

What is claimed is:

1. A continuous casting installation consisting of a) a mould arrangement which comprises a mould and an oscillatory holding device for causing the mould to oscillate in a casting position and is formed of a stationary part and a replaceable part, the replaceable part being separably connected with the stationary part and the replaceable part comprising at least one component of the mould;

b) a device for exchanging the replaceable part, which comprises a conveying device for conveying the replaceable part between an operating position and a second position in a space below the casting position, wherein c) the stationary part comprises the holding device and d) the holding device and the replaceable part are so constructed that the replaceable part may be moved by means of the conveying device out of the operating position into the second position after separation from the stationary part.

2. A continuous casting installation according to claim 1, wherein the replaceable part comprises a mould cavity wall which forms a mould cavity of the mould with a pouring opening and an outlet opening for a strand.

3. A continuous casting installation according to claim 2, wherein the replaceable part includes a coolant channel surrounding the mould cavity wall for cooling the mould cavity wall.

4. A continuous casting installation according to claim 2, wherein the replaceable part comprises foot rollers and/or spray cooling devices and/or an electromagnetic agitator for the strand at the outlet opening.

5. A continuous casting installation according to claim 2, wherein the stationary part comprises a spray cooling device for cooling the mould cavity wall.

6. A continuous casting installation according to claim 1, wherein the replaceable part comprises the mould.

7. A continuous casting installation according to claim 1, wherein the stationary part comprises a device for electromagnetic agitation and/or braking of molten metal in the mould cavity and/or in the strand and/or spray cooling device for the strand and/or measuring apparatuses for monitoring the casting operation, especially for measuring the level of the meniscus and/or for monitoring the temperature of parts of the mould.

8. A continuous casting installation according to claim 1, wherein the stationary part comprises at least one supply connection and the replaceable part is constructed in such away that the supply connection is coupled to or uncoupled from a corresponding supply connection of the replaceable part during exchange of the replaceable part, in order to effect or undo a supply connection.

9. A continuous casting installation according to claim 8, wherein the supply connection is formed for the purpose of supplying energy, coolants, lubricants or signals.

10. A continuous casting installation according to claim 1, wherein the conveying device comprises a lifting device, with which the replaceable part maybe connected and which is constructed in such a way that the replaceable part may be moved out of the operating position into the space below the casting position.

11. A continuous casting installation according to claim 1, wherein the conveying device is constructed in such a way that the replaceable part may be moved out of the operating position substantially tangentially to the strand guiding direction at the outlet opening at least along a proportion of its path and/or on a path which is in part rectilinear and/or in part curved.

12. A continuous casting installation according to claim 1, wherein the conveying device includes a part which is mounted to a first stationary member which is stationary relative to the stationary part of the mould arrangement.

13. A continuous casting installation according to claim 1, wherein the continuous casting installation comprises a plurality of mould arrangements, the position of the conveying device is adjustable with respect to any of the mould arrangements in such a way that the replaceable part of each mould arrangement may be moved by the conveying device.

14. A method of exchanging a replaceable part of the mould arrangement in a continuous casting installation, the method comprising providing the mould arrangement, the mould arrangement including a mould and an oscillatory holding device for causing the mould to oscillate in an operating position, the mould arrangement being formed of a stationary part and the replaceable part, the stationary part comprising the holding device and the replaceable part comprising at least one component of the mould and being separably connected with the stationary part, providing a conveying device for conveying the replaceable part between the operating position and a second position below the operating position, separating the replaceable part from the stationary part of the mould arrangement, and moving the replaceable part by means of the conveying device from the operating position to the second position.

15. A method according to claim 14, wherein moving the replaceable Part comprises:

moving the replaceable part out of the casting position substantially tangentially to a strand guiding direction at least along a proportion of its path and/or out of the operating position on a path which is in part rectilinear and/or in part curved.

* * * * *